United States Patent [19]

Marcel

[11] 3,945,780

[45] Mar. 23, 1976

[54] ROTARY SLIDING PARTITION MACHINE WITH FLUID CHAMBERS AT THE PARTITION ENDS

[76] Inventor: Jean Pierre Marcel, 20 rue E. Roux, Ruelle, France, 16600

[22] Filed: Aug. 5, 1974

[21] Appl. No.: 494,922

[30] Foreign Application Priority Data

Aug. 9, 1973 France ..... 73.29138

[52] U.S. Cl. ..... 418/232

[51] Int. Cl.[2] ..... F01C 1/00; F03C 3/00; F04C 1/00

[58] Field of Search ..... 418/219, 228–232, 418/261, 268

[56] References Cited

UNITED STATES PATENTS

| | | | |
|---|---|---|---|
| 1,175,153 | 3/1916 | Klinger | 418/219 |
| 3,136,262 | 6/1964 | Krawacki | 418/231 |

FOREIGN PATENTS OR APPLICATIONS

| | | | |
|---|---|---|---|
| 1,141,233 | 3/1957 | France | 418/219 |

*Primary Examiner*—John J. Vrablik

*Attorney, Agent, or Firm*—Holman & Stern

[57] ABSTRACT

The invention relates to positive-displacement fluid machines which may be used as pumps, compressors or motors.

The machine includes a piston integral with the stator and engaged in an annular cylinder formed in the rotor. Movable partitions slide in longitudinal grooves in the rotor and create fluid-work chambers in the cylinder. Cams for actuating the partitions determine, between the rotor and the stator, periodically-variable volumetric spaces filled with fluid under pressure suitable for providing an assisted control for the displacement of the partitions.

6 Claims, 3 Drawing Figures

ROTARY SLIDING PARTITION MACHINE WITH FLUID CHAMBERS AT THE PARTITION ENDS

FIELD OF THE INVENTION AND BACKGROUND OF THE INVENTION

This invention relates to positive-displacement fluid machines which may be used as motors, pumps, or compressors, of the type made up by two units defining between them at least one groove of constant section, and movable one relative to the other in the direction of said groove, at least one piston integral with one of said two units, which piston has a working section conjugate with that of said groove and is engaged in a fluid-tight manner in the groove, movable partitions in the other of said two units in such manner as to bring about selectively in said groove, to the fluid-work chambers, means for putting said chambers into communication with an inlet orifice and an outlet orifice, and cams for controlling said movable partition, said cams being unitary with the unit which carries the piston or pistons and co-operating with the ends of said partition in order to impress upon the latter a to-and-fro movement synchronized with the relative movement of said two units.

In known machines of this type, the displacements of the movable partitions are mechanically ensured by the cams, so that the movements of said cams, which must be abrupt, lead to a certain amount of wear of the mechanism.

OBJECTS OF THE INVENTION

The object of the invention is to provide a machine of the type stated which does not have the aforesaid disadvantage of the known machines.

To this end, according to the invention, the ends of the partitions are displaced in a closed space formed between said two limbs of the machine and in communication with a space in the machine filled with fluid, in such manner as also to be filled with fluid, the cams controlling said partitions being located in said closed space and determining periodically variable volumetric capacities between the ends of any two successive partitions, the configuration and the dimensions of said closed space being such that the variation in volume of each of said periodically variable volumetric capacities is equal to at least the volume of that part of each partition which penetrates cyclically more or less deeply into said closed space.

Thanks to this particular disposition, the partitions are subjected, through their ends, to the fluid pressure which prevails in said closed space, so that they are displaced under the effect of this pressure without there being any need in practise for the cams to take part. In this way practically any mechanical contact between the cams and the ends of the partitions is eliminated, and this reduces considerably the wear and tear of the machine and renders it much more quiet. The cams which remain in place, since it is they which produce the periodic variations in volume of the capacities involved, function as safety members and ensure in due course a displacement always of length and direction and of synchronization perfectly adapted to the running of the machine in the case where the action of the fluid under pressure would not provide the full efficiency desired at certain instants, especially when the machine is started.

The invention is applicable to cylindrical machines with axial partitions, as well as to flat machines with radial partitions.

An embodiment of a positive-displacement fluid machine according to the invention will now be described, by way of example, with reference to the accompanying drawings, in which:

DESCRIPTION OF A PREFERRED EMBODIMENT

Figure 1:
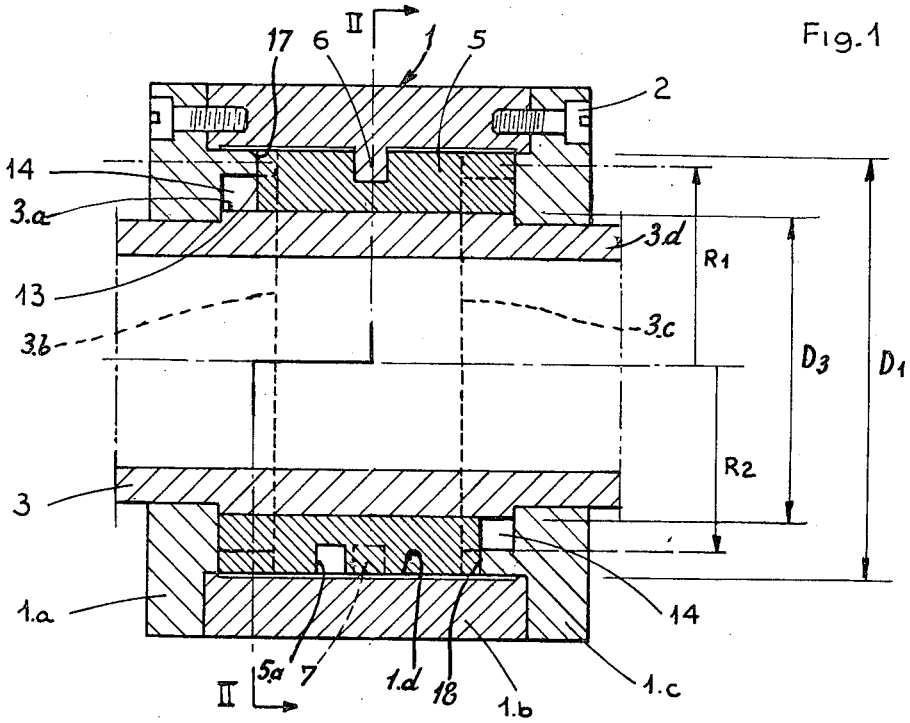
FIG. 1 is a longitudinal section along the broken line I—I of FIG. 2 of the engine assembly.
Figure 2:
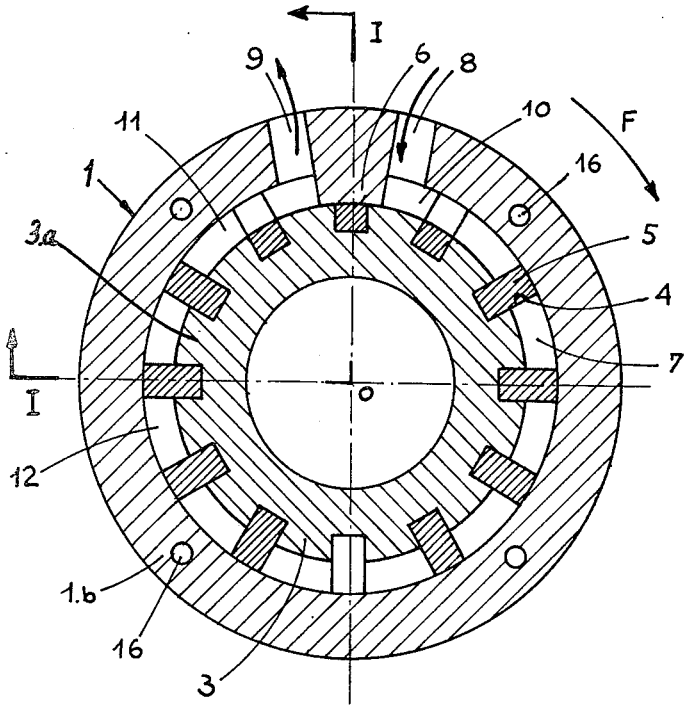
FIG. 2 is a transverse section of the engine assembly taken along section II—II of FIG. 1.

The machine shown in FIGS. 1 and 2 consists essentially of a stator 1 of three parts 1*a*, 1*b* and 1*c* assembled by screws 2 and surrounding a one piece rotor 3.

The rotor 3 comprises a main part 3*a* the two side faces of which are represented by broken lines at 3*b* and 3*c* in FIG. 1, and a central part 3*d* which constitutes the shaft of the machine, and which is tubular in this embodiment. In the cylindrical part 3*a* of the rotor there are formed, along the generatrices, grooves 4 of rectangular section in which movable partitions 5 can slide. Moreover, in the same cylindrical part 3*a* of the rotor, there is hollowed out an annular groove 7 of rectangular section forming a cylinder in which can slide, in a fluid-tight manner, a piston 6 of corresponding working section integral with the part 1*b* of the stator.

Each movable partition 5 has therein a rectangular notch 5*a* through which the piston 6 can pass, when said notch is in the path of the piston.

Orifices 8 and 9 made in the central part 1*b* of the stator place into communication with the exterior, respectively, the two fluid-work chambers 10 and 11 in the cylinder 7, which chambers are on each side of the piston 6 as far as the two partitions 5 which close the cylinder.

Figure 3:
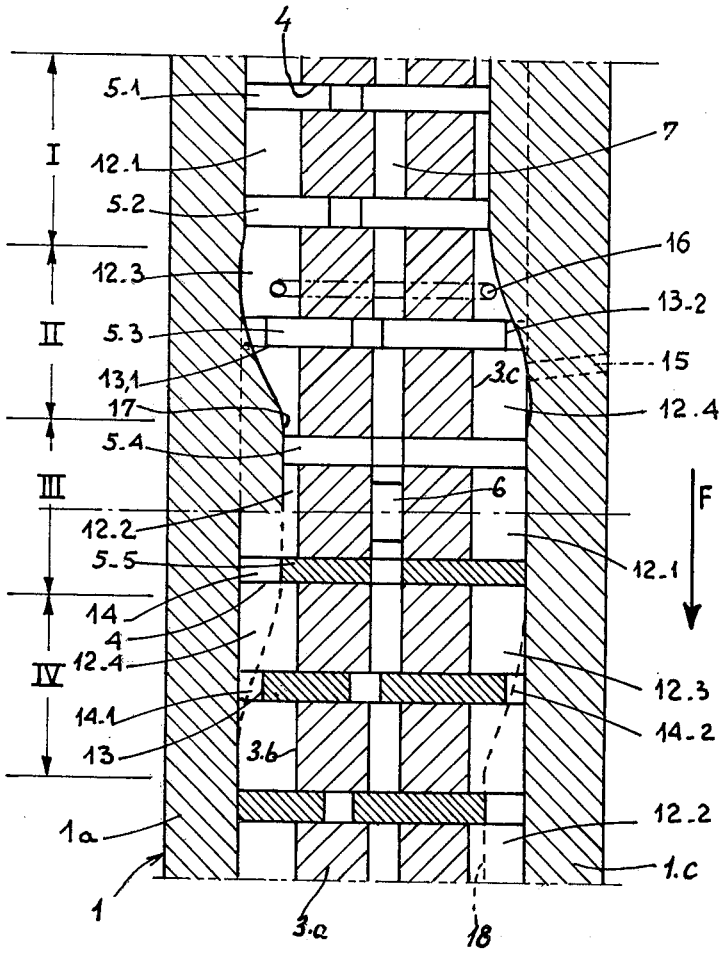
FIG. 3 shows, in its upper part, a developed view of a part of the cylinder of radius R1 of FIG. 1, and, in its lower part, a developed view of a part of the cylinder of radius R2 of FIG. 1.

The movable partitions 5 are displaced axially by fluid pressure and under the control of cams 17 and 18 projecting on to those faces of the two side parts 1*a* and 1*c* of the stator which are opposite the corresponding side faces 3*b* and 3*c* of the rotor (see also FIG. 3).

The cams 17 and 18 occupy, in a radial direction, the fraction of the space enclosed between the cylindrical surface D1 defining the bore surround of the stator and the external cylindrical surface D3 of the cylindrical parts of the rotor which are on both sides of the two side faces 3*b* and 3*c* of the active central part of said rotor. They bring into being, on both sides of the main part 3*a* of the rotor, convergent spaces, such as 12.3 (FIG. 3) opposite divergent spaces, such as 12.4, considered in the direction F of displacement of the rotor with respect to the stator. At each side of the rotor, the convergent spaces are connected to the divergent spaces by calibrated passages provided, in this example, by internal conduits 16 made in the stator.

The operation of the machine is as follows:

The fluid under pressure, admitted through the orifice 8, reaches the chamber 10 and exerts a thrust on the movable partitions 5 which has the effect of setting the rotor 3 into rotation in the direction of the arrow F.

The fluid trapped in the chamber 11 escapes progressively through the orifice 9.

If consideration is given to two adjacent partitions 5.1 and 5.2 in their positions closing the cylinder 7 (zone I, FIG. 3), they settle the limits with the stator 1 and the rotor 3 of a cavity 12.1 of volume $v1$. These two partitions, during the rotation of the rotor, go to take up at 5.4 and 5.5 (zone III, FIG. 3) the position opening the cylinder. The cavity defined above is modified, its volume $v2$ is less; the reduction in volume $V = v1 - v2$ is effected during passage in the zone II.

If consideration is given to the outside faces 13 of the partitions (FIGS. 2 and 3), the surfaces 4 seating partitions, and the side part 1*a* of the stator, they determine cavities 14 the volume of which is nil in the zone I and at a maximum, equal to $v2$ in the zone III. The increase to volume $v2$ is effected on passage of the movable partitions in the zone II.

According to the present invention, all of the cavities 12 and 14 are designed so as to be substantially fluid-tight and are maintained filled with liquid, either from the cylinder 7 by allowing slight leaks between the rotor and the stator in the direction of these cavities, or by an external feed arriving through orifices 15 such as that shown in FIG. 3.

The sum of the variations in volumes $v1$ and $v2$ of the cavities 12 and 14 is nil in order that the constant quantity of fluid confined in all of these cavities makes up the relationship between the angular displacement of the rotor which causes $v1$ to vary and the displacement of the movable partitions in their seats which causes $v2$ to vary. These volumes $v1$ and $v2$ are proportioned in order to obtain the desired displacement of the partitions in their seats according to a predetermined angle of rotation.

In a modification, the volumetric variation $v'1$ of the cavities 12 is given a value greater than the volumetric variation $v'2$ of the cavities 14, the extra fluid necessary to the displacement of the partitions being discharged through the conduits 16 (FIGS. 2 and 3) of a working section which is adjustable or is fixed after trials, from a cavity 12.3 from which the ends 13.1 of the partitions are driven inwards, towards a cavity 12.4 into which the opposite ends 13.2 of said partitions penetrate.

This embodiment permits a displacement of the partitions free from interference, the action of the fluid providing an end thrust on these partitions in accordance with their direction of displacement when the ends of these partitions, accommodated in the cavities 12.3 corresponding with the zones II, are surrounded by fluid at the same pressure.

The cams linking the guide tracks of the partitions in the zones 1 and 3 enable the relative position of the partitions with respect to the pistons to be maintained, thus avoiding any accident at the time of starting and any wear and tear following upon failure of feed when the machine is set into rotation by inertia.

The invention also provides other advantages. For example, it enables the travel of each partition to be restricted by a stop integral with the component which provides the seating for these partitions, instead of restricting this travel by guide tracks pertaining to the other component. In this case play is provided between the ends of the partitions and the guide tracks in order to avoid any contact, the passage left to the fluid playing the part of evacuation conduits 16 by connecting at one and the same side of the rotor cavities 12.3 to cavities 12.4. Any inopportune inspiration of air is suppressed in the case of machines operating as pumps, fluid accommodated in the cavities 12 creating an hydraulic joint between the rotor and the stators.

Of course, the invention is not restricted to the embodiments shown and described which have been given by way of examples; numerous modifications may be incorporated therein, in accordance with the applications contemplated, without, for that purpose, departing from the scope of the invention.

I claim:

1. A rotary sliding partition machine comprising: two units (1,3) defining between them at least one groove (7) of constant cross-section, and movable one relative to the other in the direction of said groove; at least one piston (6) secured to one of said units, which piston has a working section mating with the cross-section of said groove and is engaged in a fluid-tight manner in said groove; elongated partitions (5) with two end portions and movable in the other of said two units in a direction transverse to said groove in such a manner as to create fluid work chambers (10,11) selectively in said groove; means (8,9) for putting said chambers into communication with an inlet orifice and an outlet orifice for the fluid; two space means formed between said two units in communication with a portion of the machine filled with fluid in such a manner as also to be filled with fluid, said end portions of said partitions being displaced in said space means; and partition-controlling elements (17,18) secured to said piston-carrying unit (1) and located in said space means, said partition-controlling elements extending in the direction of said groove alternately in one and in the other of said two space means in the direction of movement of said partitions toward said end portions of said partitions to determine between the end portions of any two successive partitions periodically variable volumetric capacities (12-1, 12-2, 12-3, 12-4), the dimension of said partition-controlling elements in a direction at right angles both to the direction of said groove and to the direction of displacement of said partitions being such that the variation of volume each of said periodically variable volumetric capacities is equal to at least the volume of that part of each partition which penetrates cyclically into said space means.

2. The machine of claim 1, wherein the aforesaid dimension of said partition-controlling elements is such that the variation in volume of each of said periodically variable volumetric capacities (12-1, 12-2, 12-3, 12-4) is greater than the volume of each part of said partition which penetrates cyclically into said space means, and wherein a calibrated restricted passage (16) connects one of said space means to the other in the vicinity of said partition-controlling elements.

3. A machine according to claim 1, wherein a gap is formed by a voluntary clearance between said two units (1,3) of the machine movable one relative to the other, said space means being in communication with said gap.

4. A machine according to claim 1, wherein said partition-controlling elements extend in the direction of movement of said partitions in a progressive configuration.

5. A machine according to claim 1, wherein additional inlet means (15) are provided for feeding pressure fluid to said space means.

6. A rotary sliding partition machine comprising: two units (1,3) capable of rotating one inside the other about an axis and each having a cylindrical surface coaxial with said axis adapted to cooperate with a mating cylindrical surface of the other of said two units, said units defining between them at least one coaxial annular groove (7) of constant cross-section; at least on piston (6) secured to one (1) of said two units, said piston having a cross-section mating with said cross-section of said groove and engaged in a fluid tight manner in said groove; partitions (5) axially movable in the other (3) of said two units and extending across said groove (7) in such a manner as to determine selectively in said groove fluid work chambers (10,11); means for putting said chambers into communication with an inlet orifice (8) and an outlet orifice (9) for the fluid; two annular spaces defined between said two units, into which said end portions of said partitions penetrate and which are connected to a portion of a machine filled with fluid in such a manner as also to be filled with fluid; and partition-controlling elements (17,18) secured to the piston-carrying unit (1) and located in said annular spaces said partition controlling elements extending in a circumferential direction alternately in one and in the other of said two annular spaces and in axial direction toward said end portions of said partitions to determine, between the end portions of any two successive partitions, capacities (12-1, 12-2, 12-3, 12-4) of periodically variable volume, the radial thickness (D1/2-R2) (FIG. 1) of said partition-controlling elements being shorter than the radial thickness of said annular spaces and having such a value that the variation of volume of each of said periodically variable volumetric capacities if equal to at least the volume (14) of that part of each partition which penetrates cyclically into said spaces.

* * * * *